US008776401B2

(12) United States Patent
James et al.

(10) Patent No.: US 8,776,401 B2
(45) **Date of Patent: *Jul. 15, 2014**

(54) FLEX GROOVE SOLE ASSEMBLY WITH BIASING STRUCTURE

(71) Applicant: NIKE, Inc., Beaverton, OR (US)

(72) Inventors: Dervin A. James, Hillsboro, OR (US); John Hurd, Lake Oswego, OR (US); Lee D. Peyton, Tigard, OR (US); Tobie D. Hatfield, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/932,988

(22) Filed: Jul. 1, 2013

(65) Prior Publication Data

US 2014/0013623 A1 Jan. 16, 2014

Related U.S. Application Data

(62) Division of application No. 12/717,902, filed on Mar. 4, 2010, now Pat. No. 8,505,220.

(51) Int. Cl.
*A43B 13/16* (2006.01)

(52) U.S. Cl.
USPC ..... 36/102; 36/25 R

(58) Field of Classification Search
CPC ..... A43B 13/141
USPC ..... 36/102, 25 R, 103, 50.5, 33, 97
See application file for complete search history.

(56) References Cited

U.S. PATENT DOCUMENTS

| | | | | |
|---|---|---|---|---|
| 1,362,225 | A | 12/1920 | Carls-lund | |
| 1,964,406 | A * | 6/1934 | Pellkofer | 36/11.5 |
| 2,206,136 | A | 7/1940 | Tchetchet | |

(Continued)

FOREIGN PATENT DOCUMENTS

| | | | |
|---|---|---|---|
| DE | 55619 | C | 3/1891 |
| DE | 297864 | C | 5/1917 |
| EP | 089930 | A1 * | 9/1983 |
| WO | WO 9947013 | | 9/1999 |

OTHER PUBLICATIONS

International Search Report dated May 5, 2011, International Application No. PCT/US2010/026896, International Filing Date Mar. 2, 2011.

(Continued)

*Primary Examiner* — Ted Kavanaugh
(74) *Attorney, Agent, or Firm* — Plumsea Law Group, LLC

(57) ABSTRACT

An article of footwear includes an upper and a sole assembly. The sole assembly includes a groove that separates the sole assembly into first and second portions. Moreover, the article of footwear includes a flexible cord including a first end, a second end, and a middle portion. The middle portion extends through the sole assembly and across the groove between the first portion and the second portion. The article of footwear also includes an adjustment device that is operably coupled to the first end and the second end. The adjustment device is configured to move at least one of the first end and the second end to selectively adjust tension of the flexible cord between a first tension level and a second tension level. The first portion is more rotatable about the groove relative to the second portion at the first tension level as compared to the second tension level.

25 Claims, 8 Drawing Sheets

(56) References Cited

U.S. PATENT DOCUMENTS

| | | | | |
|---|---|---|---|---|
| 2,342,188 | A * | 2/1944 | Ghez et al. | 36/33 |
| 2,370,302 | A | 2/1945 | Henry | |
| 2,435,668 | A | 2/1948 | Behringer et al. | |
| 2,470,200 | A * | 5/1949 | Wallach | 36/33 |
| 2,922,235 | A * | 1/1960 | Meltzer | 36/13 |
| 3,481,332 | A | 12/1969 | Arnold | |
| 4,026,045 | A | 5/1977 | Druss | |
| 4,309,832 | A | 1/1982 | Hunt | |
| 4,331,152 | A | 5/1982 | Bartoli | |
| 4,391,048 | A | 7/1983 | Lutz | |
| 4,562,651 | A | 1/1986 | Frederick et al. | |
| 4,922,631 | A | 5/1990 | Anderie | |
| 4,936,028 | A | 6/1990 | Posacki | |
| 4,941,273 | A | 7/1990 | Gross | |
| 5,175,949 | A | 1/1993 | Seidel | |
| 5,243,776 | A | 9/1993 | Zelinko | |
| 5,560,126 | A | 10/1996 | Meschan et al. | |
| 5,729,912 | A | 3/1998 | Gutkowski | |
| 5,934,599 | A | 8/1999 | Hammerslag | |
| 6,055,746 | A | 5/2000 | Lyden et al. | |
| 6,115,945 | A | 9/2000 | Ellis, III | |
| 6,202,953 | B1 | 3/2001 | Hammerslag | |
| 6,247,249 | B1 | 6/2001 | Lindqvist | |
| 6,263,593 | B1 | 7/2001 | Pierce et al. | |
| 6,289,558 | B1 | 9/2001 | Hammerslag | |
| 6,378,230 | B1 | 4/2002 | Rotem et al. | |
| 6,990,755 | B2 | 1/2006 | Hatfield et al. | |
| 7,143,529 | B2 | 12/2006 | Robinson et al. | |
| 7,171,767 | B2 | 2/2007 | Hatfield et al. | |
| 7,290,357 | B2 | 11/2007 | McDonald et al. | |
| 7,392,605 | B2 | 7/2008 | Hatfield et al. | |
| 7,510,538 | B2 | 3/2009 | Wolter et al. | |
| 7,513,068 | B2 | 4/2009 | Fauver | |
| 7,540,100 | B2 | 6/2009 | Pawlus et al. | |
| 7,607,241 | B2 | 10/2009 | McDonald et al. | |
| 8,505,220 | B2 * | 8/2013 | James et al. | 36/102 |
| 2002/0095750 | A1 | 7/2002 | Hammerslag | |
| 2006/0117600 | A1 * | 6/2006 | Greene | 36/9 R |
| 2007/0266598 | A1 | 11/2007 | Pawlus et al. | |
| 2011/0047816 | A1 | 3/2011 | Nurse | |

OTHER PUBLICATIONS

Written Opinion dated May 5, 2011, International Application No. PCT/US2010/026896, International Filing Date Mar. 2, 2011.

Office Action mailed Oct. 17, 2012, EP Application No. 11751310.1, Filed Sep. 8, 2012.

European Supplementary Partial Search Report and Written Opinion dated Nov. 15, 2013, International Application No. PCT/US2011026896, filed Mar. 2, 2011.

* cited by examiner 10
12
28
33
34
32
22
18
20
15
26
19b
19a
16
14
13
30
X 32
28
38
35
74b
5.0
36
7.0
74c
33
34
12
24
22
3.0
74a
73
72

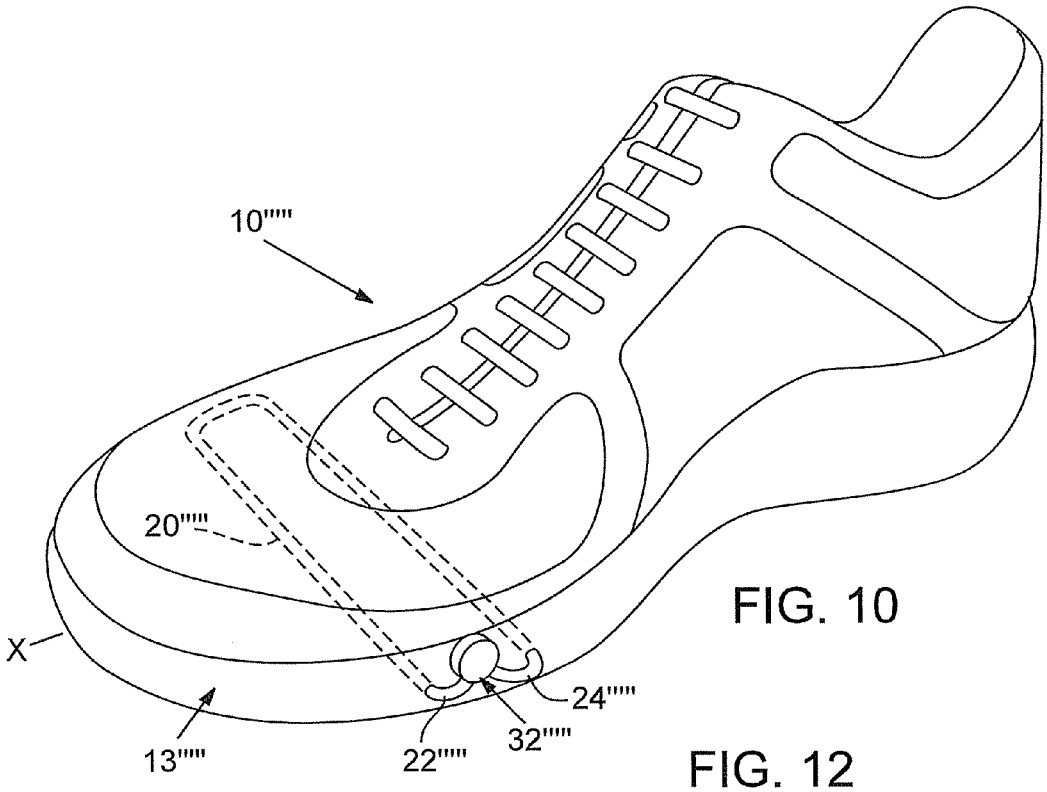
FIG. 10
FIG. 12
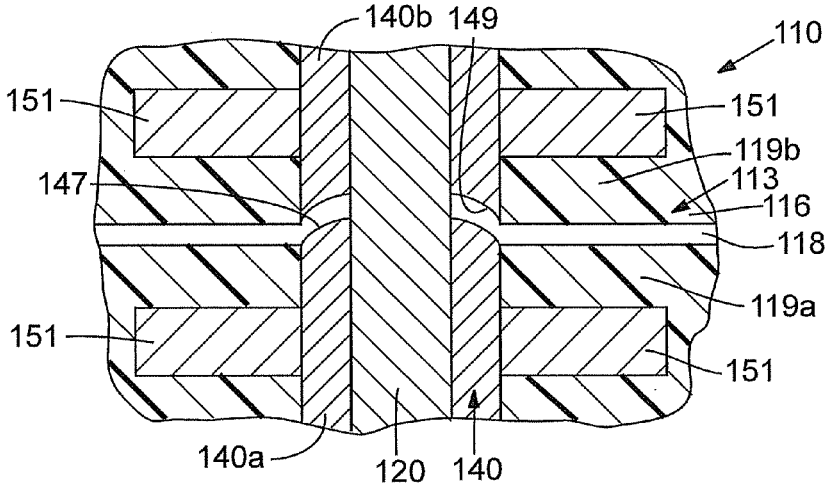

FLEX GROOVE SOLE ASSEMBLY WITH BIASING STRUCTURE

CROSS REFERENCE TO RELATED APPLICATION

This application is a divisional of co-pending U.S. patent application Ser. No. 12/717,902, filed Mar. 4, 2010, the disclosure of which is hereby incorporated by reference.

FIELD

The present disclosure relates to footwear and, more particularly, relates to an article of footwear with a flex groove sole assembly and a biasing structure.

BACKGROUND

Articles of footwear usually include an upper and a sole assembly. The upper can include sections of thin material, straps, laces, and the like for covering the wearer's foot and securing the footwear to the wearer. The sole assembly can include an outsole that is typically a unitary piece of relatively durable, high-friction material that provides traction for the footwear. Also, the sole assembly can include a midsole including foam, fluid filled bladder(s), etc. for providing cushioned support for the wearer.

The sole assembly can resiliently deform in response to loads from the wearer. For instance, walking or running can cause the sole assembly to resiliently flex and bend to thereby maintain sufficient surface contact with the ground. The sole assembly can also resiliently deflect in a direction perpendicular to the ground in order to absorb weight loads, thereby cushioning the wearer and providing greater comfort.

In some cases, the sole assembly can include deep grooves (e.g., "flex grooves") or sipes that separate the sole assembly into discrete sole elements and that increase the flexibility of the sole assembly for improved performance. More specifically, the midsole can include one or more grooves with substantially V-shaped cross sections and the depth of the groove can extend through the majority and/or all of the thickness of the midsole. (See e.g., U.S. Pat. No. 4,562,651, issued Jan. 7, 1986 to Frederick, et al., U.S. Pat. No. 6,055,746, issued May 2, 2000 to Lyden et al., U.S. Pat. No. 6,990,755, issued Jan. 31, 2006 to Hatfield at al., U.S. Pat. No. 7,171,767, issued Feb. 6, 2007 to Hatfield et al U.S. Pat. No. 7,290,357, issued Nov. 6, 2007 to McDonald et al., U.S. Pat. No. 7,392,605, issued Jul. 1, 2008 to Hatfield at al., and U.S. Pat. No. 7,607,241, issued Oct. 27, 2009 to McDonald at al., each of which is incorporated herein by reference.) As such, the sole assembly can readily flex and bend about the flex groove, allowing the sole assembly to better conform to the wearer's foot, facilitate flexing during movement of the foot, and the like.

Although conventional sole assemblies have been adequate for their intended purposes, they do suffer from certain disadvantages. For instance, the resiliency and/or flexibility of the midsole may not be suitable for a wide range of activities. More specifically, the midsole may be relatively stiff, and as such, the footwear may be suitable for walking, however, this same midsole might be too stiff for playing tennis, running, or other activities. Accordingly, the usefulness of the footwear may be somewhat limited. On the other hand, the midsole may be highly flexible to be useful for running, playing tennis, and the like; however, this same midsole might be too flexible for other activities in which a stiffer sole provides greater comfort.

Additionally, the sole assembly can wear over time. As such, the midsole may lose resiliency, and the sole assembly may grow more flexible over time, which can be unwanted and undesirable. As a result, the useful life of the footwear may be prematurely shortened. Also, the midsole may develop a curvature over time such that the toe area of the footwear curves upward away from the ground, and the footwear may be less aesthetically pleasing as a result.

SUMMARY

An article of footwear is disclosed that includes an upper and a sole assembly. The sole assembly is operably coupled to the upper. The sole assembly defines a ground engaging surface. Also, the sole assembly includes a groove that separates the sole assembly into a first portion and a second portion. The groove is open at the ground engaging surface and extends in a depth direction from the ground engaging surface. Moreover, the article of footwear includes a flexible cord including a first end, a second end, and a middle portion. The middle portion extends through the sole assembly and across the groove between the first portion and the second portion. Still further, the article of footwear includes an adjustment device supported by at least one of the upper and the sole assembly. The adjustment device is operably coupled to the first end and the second end. The adjustment device is configured to move at least one of the first end and the second end to selectively adjust tension of the flexible cord between a first tension level and a second tension level. The first portion is more rotatable about the groove relative to the second portion at the first tension level as compared to the second tension level.

Additionally, an article of footwear is disclosed that includes an upper and a sole assembly that is operably coupled to the upper. The sole assembly defines a ground engaging surface, and the sole assembly includes a groove that separates the sole assembly into a first portion and a second portion. The groove is open at the ground engaging surface and extends in a depth direction from the ground engaging surface. The sole assembly is flexible for rotation of the first portion relative to the second portion about the groove. Moreover, the article of footwear includes a biasing structure that is elongate and flexible. The biasing structure is operably coupled to the sole assembly, and the biasing structure extends across the groove between the first portion and the second portion. The biasing structure is configured to rotatingly bias the first portion and the second portion generally toward each other about the groove.

Still further, an article of footwear is disclosed that has a medial side and a lateral side. The article of footwear includes an upper and a sole assembly that is operably coupled to the upper. The sole assembly defines a ground engaging surface, and the sole assembly includes a groove that separates the sole assembly into a first portion and a second portion. The groove is open at the ground engaging surface and extends in a depth direction from the ground engaging surface. The groove extends in a length direction between the medial side and the lateral side, and the groove is exposed on the medial side and the lateral side. The sole assembly is flexible for rotation of the first portion relative to the second portion about the groove. Moreover, the article of footwear includes a flexible cord that is operably coupled to the sole assembly. The flexible cord extends across the groove between the first portion and the second portion. The flexible cord is configured to rotatingly bias the first portion and the second portion generally toward each other about the groove.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 6-11 are perspective views of the article of footwear according to various other exemplary embodiments of the present disclosure;

FIG. 12 is a cross sectional view of a portion of the article of footwear according to another exemplary embodiment of the present disclosure;

Corresponding reference numerals indicate corresponding parts throughout the several views of the drawings.

DETAILED DESCRIPTION

Figures 1, 5:
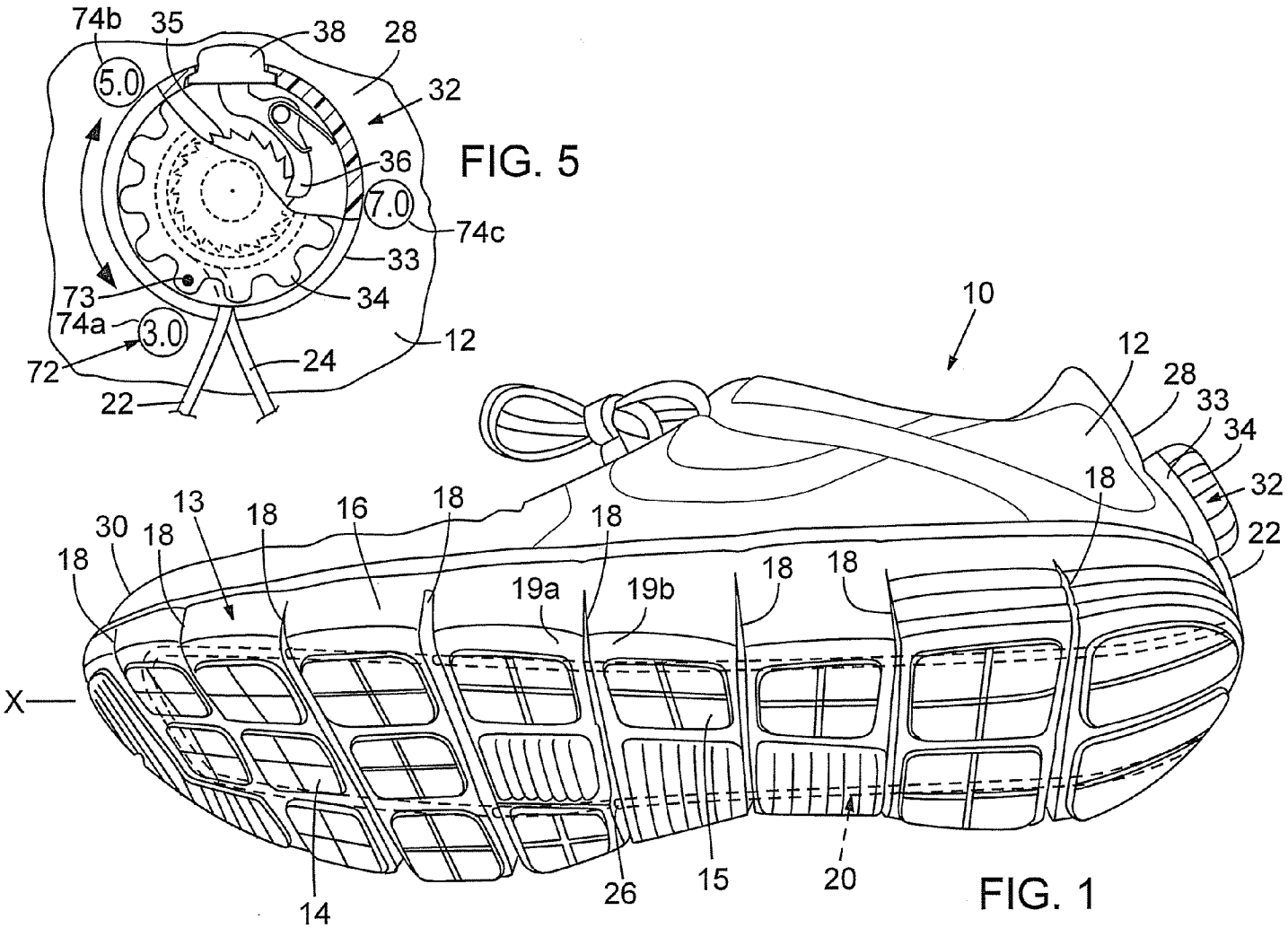
FIG. 1 is a perspective view of an article of footwear according to various exemplary embodiments of the present disclosure.
FIG. 5 is a rear view of the article of footwear.

Example embodiments will now be described more fully with reference to the accompanying drawings.

Referring initially to FIGS. 1-4, an exemplary embodiment of an article of footwear 10 is illustrated according to various teachings of the present disclosure. Generally, the article of footwear 10 includes an upper 12 and a sole assembly 13. The sole assembly 13 is operatively coupled to the upper 12 and can include an outsole 14 and a midsole 16. Although the article of footwear 10 is illustrated as an athletic shoe, it will be appreciated that the footwear 10 could be a boot, a sandal, or any other type without departing from the scope of the present disclosure.

In some embodiments, the upper 12 can include various thin sheets of material that partially overlap each other and that are operably secured to each other, for example, by stitching, adhesives, and the like. The upper 12 can also include a fastening structure, such as laces, buckles, pile tape, and/or other features for tightly securing the upper 12 to the wearer's foot. It will also be appreciated that the upper 12 can include various decorative features for aesthetically enhancing the footwear 10.

Also, the outsole 14 can include a layer of high-friction mat for providing traction. The outsole 14 can define a ground-engaging surface 15. The ground-engaging surface 15 can include a predetermined pattern of ridges, recesses, bumps, and the like for further increasing traction. The outsole 14 can be secured to the midsole 16 and/or the upper 12 in any suitable fashion, such as adhesives. In other embodiments, the outsole 14 includes a plurality of individual pads that are attached to the midsole 16 such that both the outsole 14 and midsole cooperate to define the ground-engaging surface 15. In this latter embodiment, the individual pads of the outsole 14 can be disposed at locations that are prone to increased wear.

Moreover, the midsole 16 can be coupled to and disposed between the upper 12 and the outsole 14. The midsole 16 can include a flexible, resilient foam material that is disposed between the outsole 14 and the upper 12. The midsole 16 can also include one or more embedded, fluid-filled bladders (not shown). Accordingly, the midsole 16 can provide substantial cushioning for the wearer.

The sole assembly 13 can include one or more grooves 18 that increase the flexibility of the sole assembly 13. More specifically, each groove 18 can separate the sole assembly 13 into separate, distinct portions 19*a*, 19*b*, and the portions 19*a*, 19*b* are able to move relative to each other due to the respective groove(s) 18 therebetween. The term "groove", herein, will be understood to include grooves, sipes, slits, channels, openings, passages, and the like, regardless of the method of manufacture (e.g., molded into the sole assembly 13, cut into the sole assembly 13, etc.).

The grooves 18 can incorporate one or more features of a flex groove or ripe pattern of the type disclosed in U.S. Pat. No. 4,562,651, issued Jan. 7, 1986 to Frederick, et al., U.S. Pat. No. 6,055,746, issued May 2, 2000 to Lyden et al., U.S. Pat. No. 6,990,755, issued Jan. 31, 2006 to Hatfield et al., U.S. Pat. No. 7,171,767, issued Feb. 6, 2007 to Hatfield et al., U.S. Pat. No. 7,290,357, issued Nov. 6, 2007 to McDonald et al., U.S. Pat. No. 7,392,605, issued Jul. 1, 2008 to Hatfield et al., and U.S. Pat. No. 7,607,241, issued Oct. 27, 2009 to McDonald et al., each of which is incorporated herein by reference. However, it will be appreciated that the grooves 18 can have any suitable geometry and can be disposed at any suitable location on the footwear 10.

Figure 2:
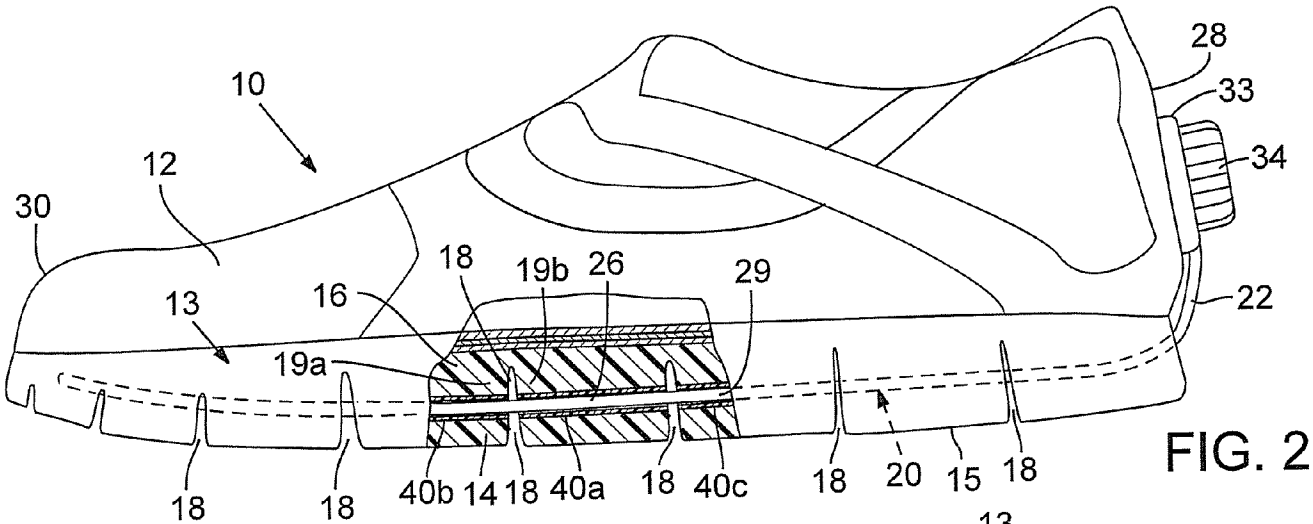
FIG. 2 is a side view and partial section view of the article of footwear of FIG. 1.
Figure 4:
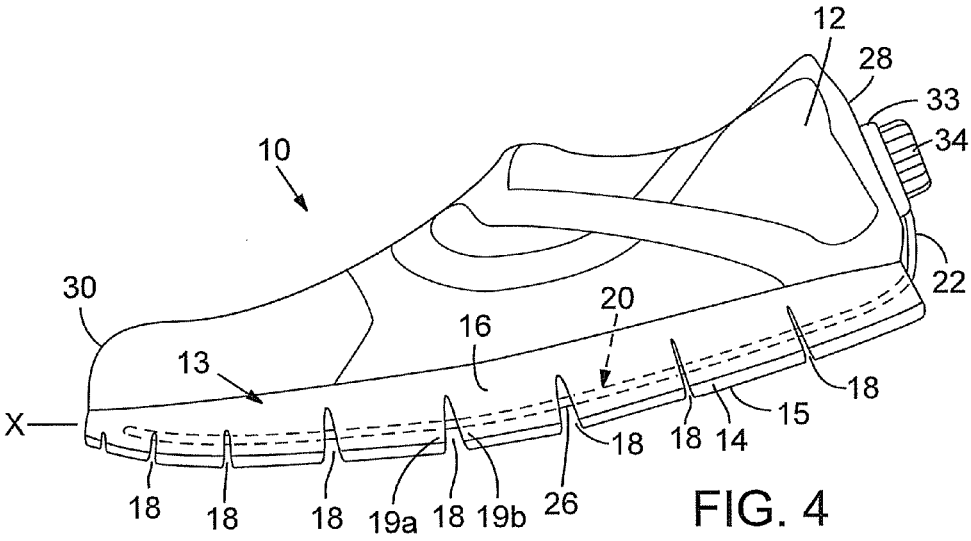
FIG. 4 is a side view of the article of footwear of FIG. 1.

The grooves 18 can each extend through the sole assembly 13 in a depth direction generally perpendicular to the ground-engaging surface 15 as shown in FIGS. 1, 2, and 4. The grooves 18 can have any suitable depth within the sole assembly 13, and the depth direction of the grooves 18 can be at a positive, acute angle relative to the ground-engaging surface 15. The grooves 18 can be open at the ground-engaging surface 15; however, it will be appreciated that the grooves 18 can be closed at the ground-engaging surface 15. Also, one or more of the grooves 18 can extend entirely through the outsole 14 and partially through the midsole 16 (e.g., through the majority of the midsole 16). In some embodiments, the grooves 18 can extend only through the midsole 16. In addition, the depth of the grooves 18 can vary throughout the sole assembly 13.

Furthermore, the grooves 18 can each be axially straight, the grooves 18 can be substantially parallel to each other, and the longitudinal axis of the grooves 18 can extend substantially perpendicular to a longitudinal axis X of the footwear. The grooves 18 can be spaced apart at any suitable distance. It will be appreciated that the grooves 18 can each have a longitudinal axis that extends in any suitable direction. For instance, the grooves 18 can extend parallel or at an acute angle relative to the axis X. Moreover, it will be appreciated that the grooves 18 can each have a non-linear axis. For instance, one or more of the grooves 18 can have a curved or wavy (e.g., generally sinusoidal) longitudinal axis. In addition, the grooves 18 can be continuous (e.g., ring-shaped).

Moreover, as shown in FIGS. 1, 2, and 4, the grooves 18 can each have a substantially V-shaped cross section and can have a relatively small width when the sole assembly 13 is at rest (FIG. 2). In some embodiments, the width of the grooves 18 can be so small that the first and second portions 19*a*, 19*b* abut at least partially against each other when the sole assembly 13 is at rest. When the sole assembly 13 is flexed (FIG. 4), the width of the grooves 18 increases, and the portions 19*a*, 19*b* move away from each other as will be discussed.

It will be appreciated that the article of footwear 10 can include any suitable number of grooves 18 on any suitable location of the sole assembly 13. Moreover, the sole assembly 13 may not include any grooves 18, and the article of footwear 10 would remain within scope of the present disclosure.

Additionally, it will be appreciated that the grooves 18 can substantially increase flexibility of the sole assembly 13. For instance, the grooves 18 can allow the portions 19*a*, 19*b* to hingeably rotate about the respective longitudinal axis of the respective groove 18 for increased flexibility of the sole assembly 13. Furthermore, in some embodiments, the location of the grooves 18 can correspond to natural, anatomical points of flexure of the wearer's foot. As such, the grooves 18 can promote natural flexure of the wearer's foot for greater comfort and performance.

Furthermore, the article of footwear 10 can include a biasing structure 20. The biasing structure can bias the portions 19*a*, 19*b* of the sole assembly 13 toward each other in a manner to be described in greater detail below. More specifically, the tension in the biasing structure 20 can affect (i.e., limit) the stiffness and flexibility of the sole assembly 13 as will be discussed.

The biasing structure 20 can be a resiliently extendable, flexible, and elastic elongate cord. The biasing structure 20 can also include woven elastic strands, such as a bungee cord. However, it will be appreciated that the biasing structure 20 can be nonextendable and nonresilient, such as a braided metallic cord, thread, or wire. In still other embodiments, the biasing structure 20 can include portions that are resiliently extendable and other portions that are nonextendable. For instance, the biasing structure 20 can include a relatively resiliently extendable portion at a first longitudinal location along its axis and another relatively nonextendable portion at a second longitudinal location along its axis. The biasing structure 20 can be bendable so as to be routed along any suitable location on the footwear 10. It will be appreciated that the biasing structure 10 can have any suitable shape and can include any suitable material.

Figure 3:
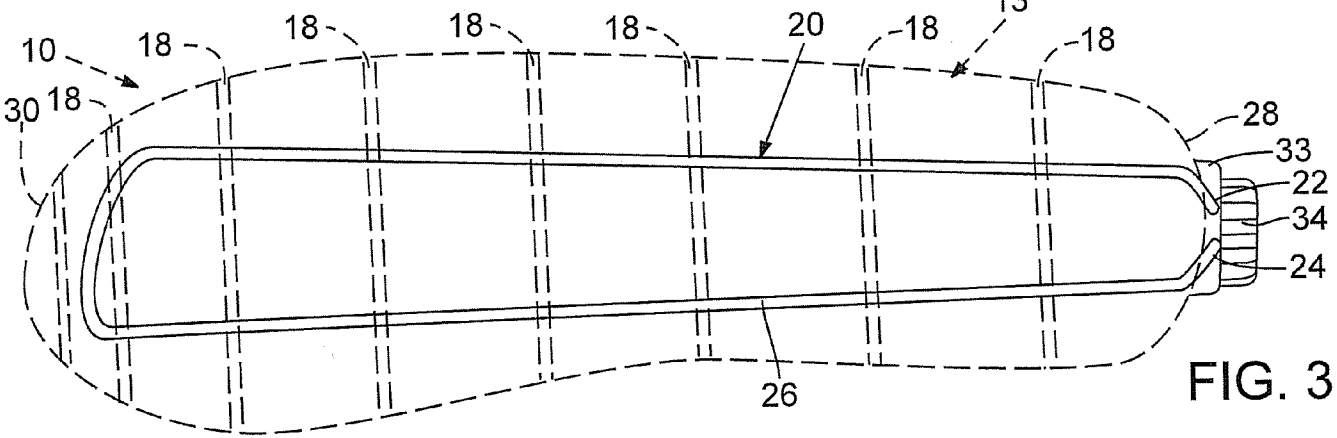
FIG. 3 is a bottom view of the article of footwear of FIG. 1.

The biasing structure 20 can include a first end 22 and a second end 24 (FIG. 3). The biasing structure 20 can further include a middle portion 26 that extends between the first and second ends 22, 24. The middle portion 26 can extend through and can be operably coupled to the sole assembly 13, and the first and second ends 22, 24 can extend out of a posterior portion 28 of the sole assembly 13 to be operably secured to the upper 12 and/or the sole assembly 13. More specifically, the middle portion 26 can extend through the midsole 16, through an elongate passage 29 defined therein. As such, the middle portion 26 can be enclosed and contained within the passage 29 and directly coupled to the midsole 16. The elongate passage 29 and the middle portion 26 can have similar dimensions such that the middle portion 26 fits snugly within the passage 29.

Also, the sole assembly 13 can include one or more reinforcing tubes 40*a*, 40*b*, 40*c* as shown in FIG. 2. The reinforcing tubes 40*a*, 40*b*, 40*c* can be made out of polymeric tubing. The reinforcing tubes 40*a*, 40*b*, 40*c* can extend through the midsole 16 and can be fixed thereto. For instance, the reinforcing tubes 40*a*, 40*b*, 40*c* can be fixedly embedded within the midsole 16 via a molding process. The reinforcing tubes 40*a*, 40*b*, 40*c* may or may not extend across the grooves 18. For instance, as shown in the exemplary embodiment shown in FIG. 2, reinforcing tube 40*a* can be embedded the first portion 19*a* of the sole assembly 13, and the reinforcing tube 40*b* can be embedded within the second portion 19*b* of the sole assembly 13. The biasing structure 20 can extend across and within the groove 18 and can be received in each of the tubes 40*a*, 40*b*. Accordingly, the tubes 40*a*, 40*b* can define the passage 29 through which the biasing structure 20 is threaded. The tube 40*c* and any additional tubes can similarly receive other axial portions of the biasing structure 20 in order to operably secure the biasing structure 20 to the sole assembly 13. It will be understood that the footwear 10 can include any number of tubes 40*a*, 40*b*, 40*c* along the axial length of the biasing structure 20. Moreover, it will be appreciated that the footwear 10 can include a single, continuous reinforcing tube 40*a* that extends continuously along the majority of the axial length of the biasing structure 20.

As such, the reinforcing tubes 40*a*, 40*b*, 40*c* can reinforce the material of the midsole 16, thereby inhibiting wear of the sole assembly 13 otherwise caused by friction between the biasing structure 20 and the material of the midsole 16. Also, the biasing structure 20 can be loosely and/or slidably received within the reinforcing tubes 40*a*, 40*b*, 40*c* such that the biasing structure 20 can move within the reinforcing tubes 40*a*, 40*b*, 40*c* when tension in the biasing structure 20 is adjusted as described in greater detail below. Furthermore, the coefficients of friction can be relatively low between the biasing structure 20 and the reinforcing tubes 40*a*, 40*b*, 40*c* such that the biasing structure 20 can slide in the tubes 40*a*, 40*b*, 40*c* with relatively little resistance. In addition, the tubes 40*a*, 40*b*, 40*c* can distribute forces from the biasing structure 20 across a wider surface area of the midsole 16 such that the midsole 16 is less likely to be cut by the biasing structure 20.

It will be appreciated that the reinforcing tubes 40*a*, 40*b*, 40*c* are optional components of the footwear 10 of the present disclosure. In some embodiments, for instance, the tubes 40*a*, 40*b*, 40*c* are not included, and the biasing structure 20 is received directly in the material of the sole assembly 13. Also, in some embodiments, the biasing structure 20 is fixed directly to the material of the sole assembly 13 (e.g., via adhesives, via a molding process, and the like).

In the exemplary embodiment of FIGS. 1-4, the middle portion 26 of the biasing structure 20 can extend axially from the posterior portion 28 toward an anterior portion 30, and the middle portion 26 (and the passage 29) can have an approximately one hundred eighty degree (180°) turn adjacent the anterior portion 30 to curve back toward the posterior portion 28. The middle portion 26 can turn back toward the posterior portion 28 at any suitable radius. As such, both first and second ends 22, 24 can extend out of the posterior portion 28 and can be spaced apart from each other on opposite sides of the axis X. However, it will be appreciated that the biasing structure 20 can extend through any portion of the sole assembly 13 or any other portion of the footwear. Also, it will be appreciated that one or more of the ends 22, 24 can be disposed within the sole assembly 13 without departing from the scope of the present disclosure.

Figure 11:
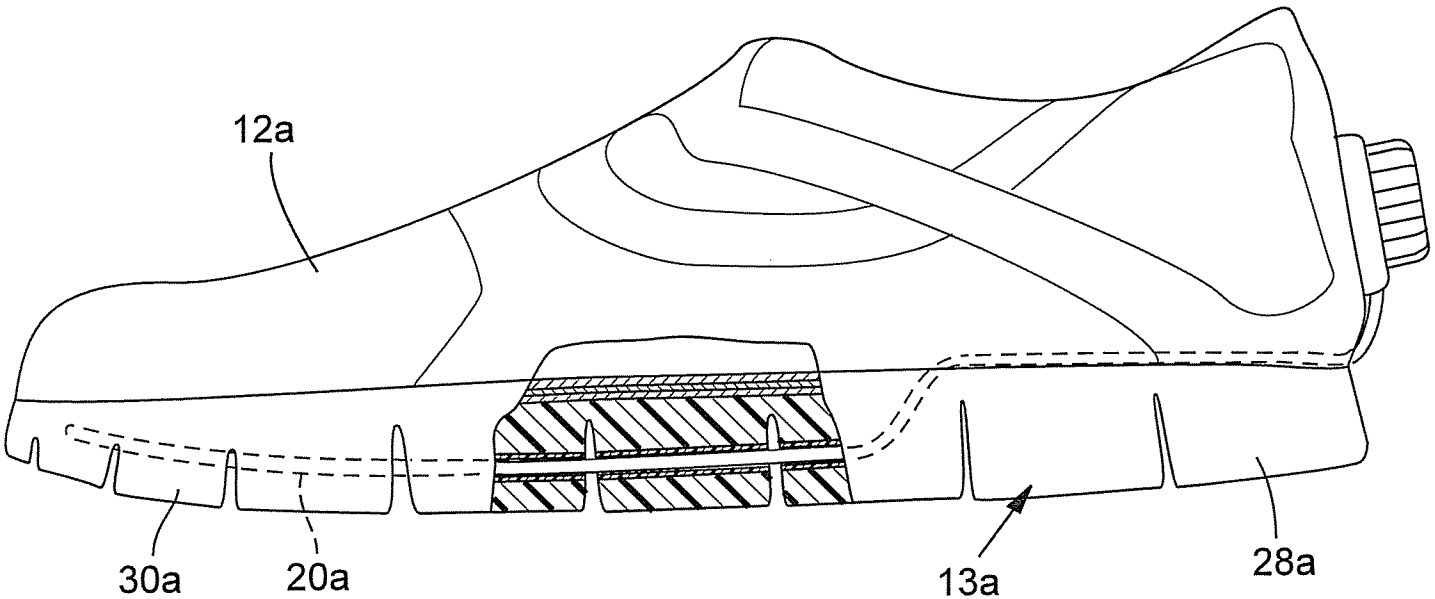

In addition, it will be appreciated that any portion of the biasing structure 20 can be disposed in or on the upper 12 without departing from the scope of the present disclosure. For instance, as shown in the embodiment shown in FIG. 11, the biasing structure 20*a* can be partially attached (e.g., embedded) within the sole assembly 13*a* and can also be partially attached (e.g., embedded and/or enclosed) within the upper 12*a*. For instance, the biasing structure 20*a* can extend through the anterior portion 30*a* of the sole assembly 13*a*, and the biasing structure 20*a* can also extend through the upper 12*a* adjacent the posterior portion 28*a*. Accordingly, the biasing structure 20*a* can affect the stiffness in a localized portion of the sole assembly 13*a* (i.e., within the anterior portion 30*a*) without significantly affecting the stiffness of the sole assembly 13*a* in the posterior portion 28*a*. Also, the biasing structure 20*a* can be routed through both the sole assembly 13*a* and the upper 12*a* in order to bias the sole assembly 13*a* and the upper 12*a* towards each other. Moreover, the biasing structure 20*a* can be routed through the upper 12*a* for selectively adjusting stiffness tuning) select portions of the upper 12*a*.

Furthermore, the middle portion 26 can extend substantially parallel to the ground-engaging surface 15. However, it will be appreciated that the middle portion 26 can extend at an acute angle relative to the ground-engaging surface 15. For instance, in some exemplary embodiments, the axis of the middle portion 26 can extend in a zig-zagging direction toward and away from the ground-engaging surface 15. Also, the middle portion 26 can extend through the midsole 16 and can be spaced apart from the outsole 14. However, it will be appreciated that the middle portion 26 can extend through the midsole 16 and/or the outsole 14.

Moreover, the biasing structure 20 can extend across one or more of the grooves 18. As such, the biasing structure 20 can extend between the individual portions 19*a*, 19*b* of the sole assembly 13.

It will be appreciated that the biasing structure 20 can apply a biasing force to the sole assembly 13. More specifically, the biasing structure 20 can bias the portions 19*a*, 19*b* of the sole assembly 13 toward each other to thereby limit and reduce the flexibility of the sole assembly 13.

Moreover, the article of footwear 10 can include an adjustment device, generally indicated at 32. The first and second ends 22, 24 of the biasing structure 20 can be operably coupled to the adjustment device 32 such that the adjustment device 32 can be used to adjust an amount of biasing force that the biasing structure 20 applies to the sole assembly 13. More specifically, the adjustment device 32 can adjust tension in the biasing structure 20 as discussed in greater detail below. The adjustment device 32 can allow for manual adjustment of the biasing force applied by the biasing structure 20, and or the adjustment device 32 can allow for automatic adjustment of the biasing force. The adjustment device 32 can incorporate one or more features disclosed in U.S. Pat. Nos. 5,934,599, 6,202,953, and/or 6,289,558, each to Hammerslag, each of which is incorporated herein by reference in its entirety.

The adjustment device 32 can include a base 33, which can be made from rigid polymeric material. The base 33 can be fixed to the posterior portion 28, to the upper 12 and/or the sole assembly 13. The adjustment device 32 can also include a spool 34, which can be made of rigid polymeric material. The spool 34 can be rotatably coupled to the base 33, and the first end 22 and/or the second end 24 of the biasing structure 20 can be spooled on the spool 34. For instance, in some embodiments, the first end 22 can be fixed to the base 33 while the second end 24 spools on the spool 34. In another embodiment, both ends 22, 24 spool and unspool on the spool 34.

Rotation of the spool 34 in one direction relative to the base 33 can spool the second end 24, pull the second end 24 longitudinally away from the first end 22, and increase tension (i.e., biasing force) in the biasing structure 20. Accordingly, the biasing structure 20 draws the portions 19*a*, 19*b* of the sole assembly 13 toward each other and increase stiffness in the sole assembly 13. On the other hand, rotation of the spool 34 in the opposite direction can unspool the second end 24 from the spool 34, thereby reducing tension (i.e., biasing force) in the biasing structure 20. Accordingly, the biasing structure 20 allows the portions 19*a*, 19*b* to move away from each other and decreases stiffness in the sole assembly 13.

As shown in FIG. 5, the adjustment device 32 can also include a plurality of notches 35. The notches 35 can be included on the spool 34, between the spool 34 and the base 33. Furthermore, the adjustment device 32 can also include a catch 36. The catch 36 can be moveably coupled to the base 33, and the catch 36 can be selectively received within one or more of the notches 35 to inhibit rotation of the spool 34. Additionally, the adjustment device 32 can include a release 38, such as button, lever, or the like. The release 38 can be operably coupled to the catch 36 for moving the catch 36 in and/or out of the notches 35. Furthermore, the spool 34 can be biased for rotation in one direction (e.g., in the direction that causes unspooling of the end(s) 22, 24 of the biasing structure 20). Moreover, the catch 36 can be biased toward the notches 35.

Accordingly, if the wearer desires to tighten up the sole assembly 13 (i.e., to increase biasing of the portions 19*a*, 19*b* toward each other), the user can manipulate the release 38 to move the catch 36 out of the notch(es) 35, and the wearer can manually rotate the spool 34 in one direction to further spool the ends 22, 24 of the biasing structure 20 on the spool 34. Then, the catch 36 can be received in one or more of the notches 35 to substantially lock the spool 34 against rotation and to retain the biasing structure 20 at the set level of biasing.

If the wearer desires to loosen the sole assembly 13 (i.e., to decrease biasing of the portions 19*a*, 19*b* toward each other), the wearer can manipulate the release 38 to allow the spool 34 to rotate in the opposite direction. Then, the catch 36 can be received in one or more of the notches 35 to substantially lock the spool 34 against rotation and to retain the biasing structure 20 at the set level of biasing.

It will be appreciated that the adjustment device 32 can be of any suitable type other than the type shown in FIG. 5. In other embodiments, the adjustment device 32 can include a slider which the user can manipulate to adjust the level of stiffness of the footwear 10.

Still further, as shown in FIG. 5, the adjustment device 32 can include an indicator system 72 that indicates the stiffness of the sole assembly 13 that has been set by the wearer. The indicator system 72 can be a visual indicator system, an audible indicator system, a tactile indicator system, or any other suitable type. As shown in FIG. 5, the indicator system 72 can include a first indicator 73 and a plurality of second indicators 74*a*, 74*b*, 74*c*. The first indicator 73 can be a dot or other shape that is located on the spool 34, and the second indicators 74*a*, 74*b*, 74*c* can be numbers or other symbols that are spaced evenly about the spool 34 on the upper 12. The second indicators 74*a*, 74*b*, 74*c* can correspond to individual, predetermined biasing levels (i.e., stiffness levels) for the sole assembly 13. Thus, when the first indicator 73 is rotated to be aligned with the second indicator 74*a*, the sole assembly 13 can be at a first predetermined level of stiffness due to the set level of tension in the biasing structure 20. Also, when the first indicator 73 is rotated to be aligned with the other second indicators 74*b*, 74*c*, the sole assembly 13 can be at different levels of stiffness. Accordingly, the indicator system 72 can allow the user to conveniently and accurately set the stiffness of the sole assembly 13 to these predetermined stiffness levels.

It will be appreciated that the indicator system 72 can be of any suitable type. For instance, if the indicator system 72 is an audible indicator system 72, the indicator system 72 can provide a predetermined noise (e.g., a predetermined number of audible clicks) corresponding to a predetermined level of stiffness.

Also, it will be appreciated that, because the biasing structure 20 extends primarily in the anterior/posterior direction, the biasing structure 20 can adjust stiffness of the sole assembly 13 primarily in the anterior/posterior direction. However, it will be appreciated that the biasing structure 20 can be disposed on any suitable portion of the footwear 10 for adjusting stiffness of a corresponding portion of the footwear 10. As such, the biasing structure 20 can be routed through a localized region of the footwear 10 for adjusting stiffness at that corresponding region.

Figure 6:
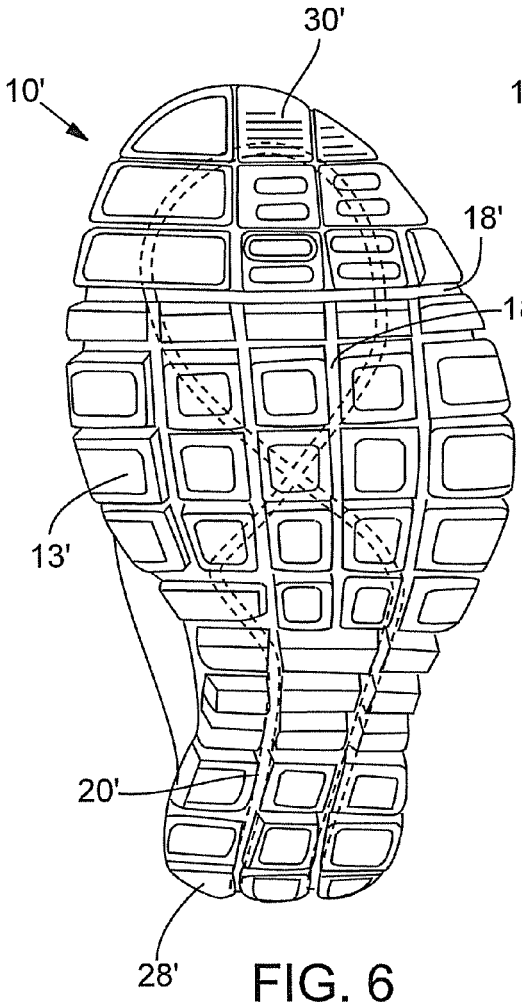

For instance, as shown in the embodiment of FIG. 6, the biasing structure 20' can extend from the posterior portion 28' to the anterior portion 30' of the footwear 10', and the biasing structure 20' can also loop over itself adjacent the anterior portion 30'. Thus, by adjusting the biasing structure 20' as discussed above, the stiffness of the sole assembly 13' can be adjusted. More specifically, the stiffness of the sole assembly 13' in both the anterior/posterior and medial/lateral directions can be adjusted. Moreover, the grooves 18' can extend in a medial/lateral direction as well as in the anterior/posterior direction such that the biasing structure 20' can adjust the stiffness of the sole assembly 13' in both the anterior/posterior and medial lateral directions.

Figure 7:
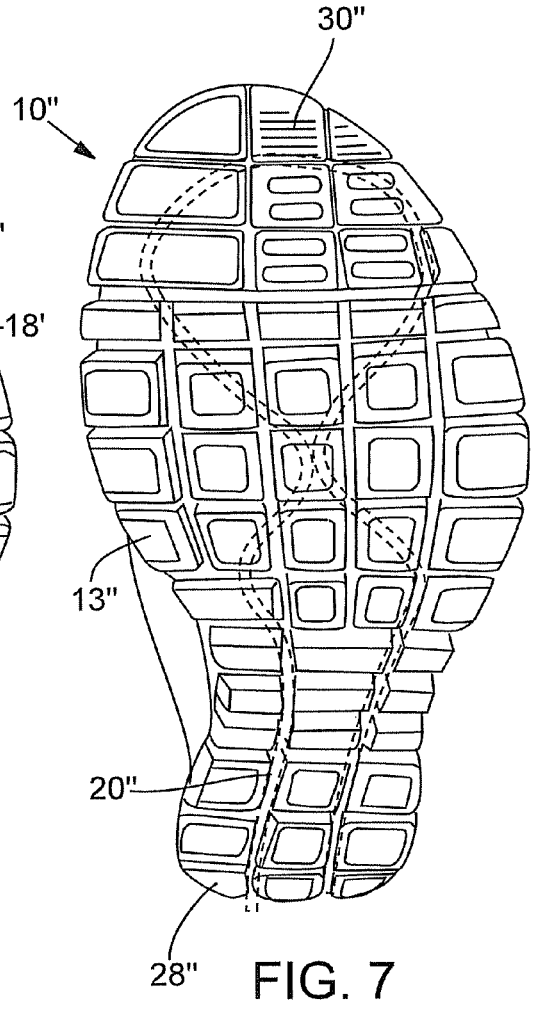

Furthermore, as shown in the embodiment of FIG. 7, the biasing structure 20" can extend from the posterior portion 28" to the anterior portion 30" of the footwear 10", and the biasing structure 20" can also have an hourglass-type curvature adjacent the anterior portion 30". Thus, by adjusting the biasing structure 20" as discussed above, the biasing structure 20" can bias medial and lateral sides of the sole assembly 13" toward each other. Also, by adjusting the biasing structure 20" in an opposite direction, the sole assembly 13" can be less stiff in the medial/lateral direction.

Figure 8:
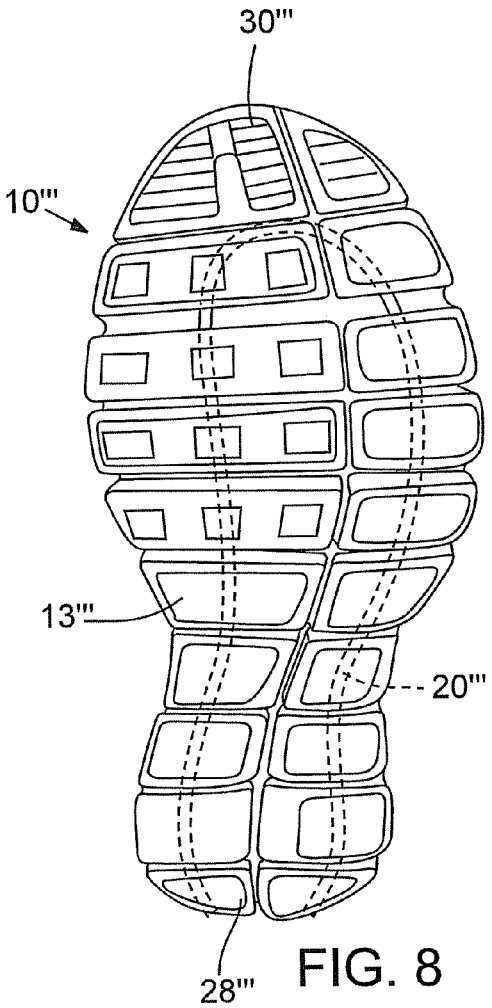

In addition, as shown in the embodiment of FIG. 8, the biasing structure 20''' can extend from the posterior portion 28''' toward the anterior portion 30''' and back again. Also, the curved axis of the biasing structure 20''' can correspond substantially to the curvature of the outer periphery of the sole assembly 13'''.

Figure 9:
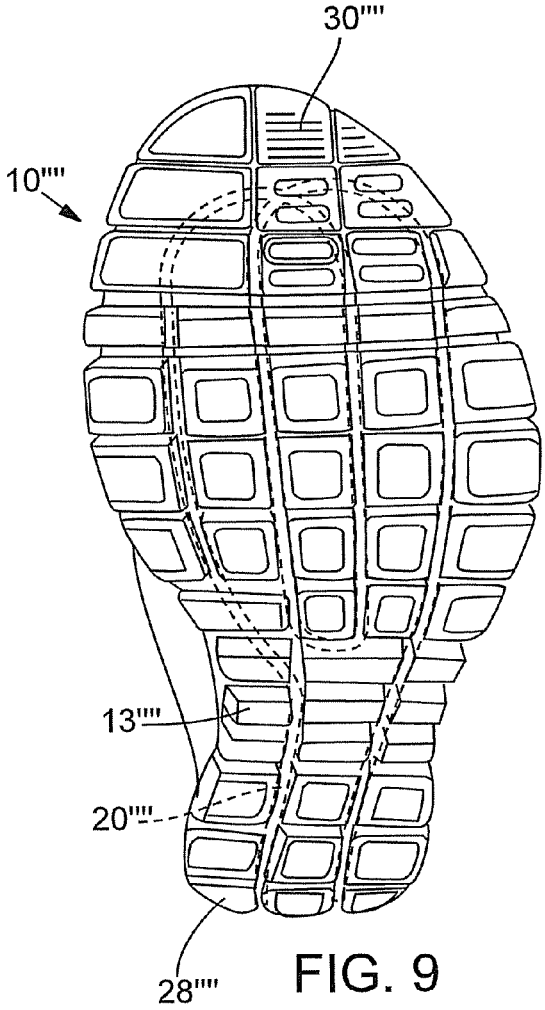

Moreover, as shown in the embodiment of FIG. 9, the biasing structure 20'''' can extend from the posterior portion 28'''', toward the anterior portion 30'''', back toward the posterior portion 28'''', then back toward the anterior portion 30'''', loop over itself, and curve back toward the posterior portion 28''''. Because the biasing structure 20'''' is located substantially in the anterior portion 30'''' and bops over itself in the anterior portion 30'''', the biasing structure 20'''' can adjust stiffness primarily in the anterior portion 30'''' of the footwear 10''''.

Still further, as shown in the embodiment of FIG. 10, the biasing structure 20''''' can extend primarily in a medial-lateral direction. More specifically, the biasing structure 20''''' can extend from the medial forefoot area, toward the lateral forefoot area, and can loop back toward the medial forefoot area. The biasing structure 20''''' can be substantially perpendicular to the axis X of the footwear 10'''''. Also, the biasing structure 20''''' can include a first end 22''''' and a second end 24''''' that each extend out of the sole assembly 13''''' to be operatively coupled to an adjustment device 32''''' of the type discussed above. As shown, the adjustment device 32''''' can be operatively coupled to the external, medial forefoot area of the sole assembly 13'''''. By adjusting the adjustment device 32''''', the biasing structure 20''''' can be used to change the stiffness under the ball of the wearer's foot, primarily in the medial-lateral direction. It will also be appreciated that the sole assembly 13''''' in the embodiment shown does not include grooves of the type discussed above; however, it will be appreciated that the sole assembly 13''''' can include grooves without departing from the scope of the present disclosure.

Accordingly, the wearer can selectively adjust the flexibility of the sole assembly 13. Thus, the article of footwear 10 can be more versatile for use in a wider range of activities, and adequate comfort can be maintained. Also, the flexibility of the sole assembly 13 can be adjusted to compensate for wear.

It will be appreciated that the of footwear 10 can be modified in various ways. For instance, in some embodiments, the footwear 10 includes a plurality of passages 29, and the wearer can choose which passage 29 to thread the biasing structure 20 through. Accordingly, the wearer can select the area of the sole assembly 13 to be biased by the biasing structure 20. Furthermore, in some embodiments, the wearer can select from different biasing structures 20. For instance, the footwear 10 can be part of a kit that includes a plurality of biasing structures 20, each with a different spring constant. As such, the wearer can select one of the biasing structures 20 to thread into the sole assembly 13 in order to obtain a desired amount of biasing supplied from the biasing structure 20 on the sole assembly 13. Moreover, in some embodiments, the footwear 10 can include a plurality of biasing structures 20, each with a respective adjustment device 32.

In addition, in some embodiments, the adjustment device 32 can be configured for automatically adjusting the amount of stiffness (e.g., with the touch of a single button). Moreover, in some embodiments, the adjustment device 32 can be set digitally by the user (e.g., by typing a present amount of stiffness into a keypad).

Referring now to FIG. 12, a portion of another exemplary embodiment of the article of footwear 110 is illustrated. Components that are similar to the embodiments of FIGS. 1-4 are indicated by corresponding reference numerals increased by 100.

As shown, the biasing structure 120 can extend across a groove 118 within the sole assembly 113 similar to the embodiments discussed above. Furthermore, the biasing structure 120 can be received within reinforcing tubes 140*a*, 140*b*, which are each fixed within the sole assembly 113 (e.g., embedded within the midsole 116). More specifically, the tube 140*a* can be fixed to a first portion 119*a* of the sole assembly 113, and the tube 140*b* can be fixed to a second portion 119*b* of the sole assembly 113.

The reinforcing tube 140*a* can include a projected end 147, and the reinforcing tube 140*b* can include a recessed end 149. The projected end 147 can have a curvature that substantially conforms to a curvature of the recesses end 149. As such, the projected end 147 can be received and can fit within the recessed end 149, for instance if the groove 118 is closed. Thus, if the biasing structure 120 pulls the portions 119*a*, 119*b* together or if the natural flexure of the sole assembly 113 causes the groove 118 to close, then the ends 147, 149 can fit together. Moreover, if the portions 119*a*, 119*b* rotate toward each other, and the ends 147, 149 are slightly misaligned, the recessed end 149 can guide the projected end 147 to fit within the recessed end 149 because the ends 147, 149 each have a corresponding curvature. Thus, when the ends 147, 149 fit together, the reinforcing tubes 140*a*, 140*b* can provide additional structural rigidity to the sole assembly 113 for added stiffness, for added comfort for the wearer, for increased wear resistance, etc.

In addition both reinforcing tubes 140*a*, 140*b* can each include anchoring projections 151. Each anchoring projection 151 can be a thin, elongate, rigid member that extends transversely (e.g., perpendicularly) away from the axis of the respective reinforcing tube 140*a*, 140*b*. In some embodiments, each reinforcing tube 140*a*, 140*b* can include a plurality (e.g., two) anchoring projections 151 that extend therefrom. Also, in some embodiments, the anchoring projection 151 can be integrally connected to its respective reinforcing tube 140*a*, 140*b*. The anchoring projection 151 can be fixed to (e.g., embedded via a molding process) to the midsole 116 or other portion of the sole assembly 113. The anchoring projection 151 can distribute loads from the respective reinforcing tube 140*a*, 140*b* to the sole assembly 113. Accordingly, the sole assembly 113 is less likely to be damaged due to stress concentrations.

Figure 13:
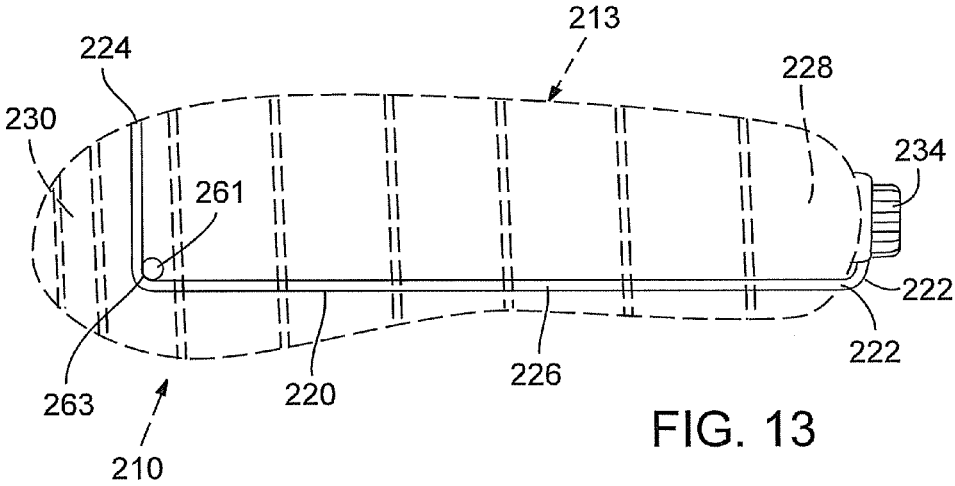
FIG. 13 is a bottom view of the article of footwear according to another exemplary embodiment of the present disclosure.

Referring now to FIG. 13, another exemplary embodiment of an article of footwear 210 is illustrated. Components that are similar to the embodiments of FIGS. 1-4 are indicated by corresponding reference numerals increased by 200.

The article of footwear 210 can include a biasing structure 220 with a first end 222, a second end 224, and a middle portion 226. The first end 222 can be operably coupled to an adjustment device 234 adjacent the posterior portion 228 of the footwear 210, and the second end 224 of the biasing structure 220 can be operably coupled (e.g., fixed) to the sole assembly 213 adjacent the anterior portion 230. The second end 224 can extend partially out of the sole assembly 213 and can be fixed on an outer surface of the sole assembly 213, or the second end 224 can be embedded within the sole assembly 213 adjacent the outer surface of the sole assembly 213. Furthermore, the middle portion 226 can extend generally parallel to the axis X along the posterior portion 228, and the middle portion 226 can extend transversely (i.e., laterally) away from the axis X. Thus, the flexibility of the sole assembly 213 can be adjusted along the axis X of the footwear 210 and in the medial-lateral direction under the ball of the wearer's foot.

In some embodiments, the footwear 210 can include a stake 261. The stake 261 can be a substantially rigid member and can include at least one rounded surface 263. The stake 261 can be fixed to (e.g., embedded via a molding process) to the sole assembly 213. The biasing structure 220 can abut against the rounded surface 263 and can wrap partially around the stake 261.

It will be appreciated that the article of footwear 210 can include a plurality of stakes 261, and the stakes 261 can be disposed at any suitable location on the footwear 210. Accordingly, the stake(s) 261 can provide a convenient means for routing the biasing structure 220 within the footwear 210.

Figure 14:
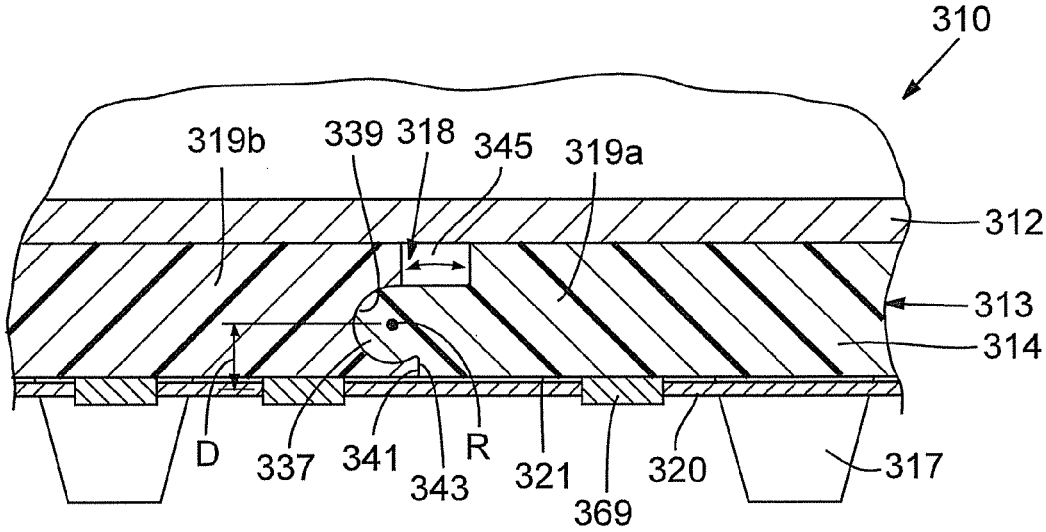
FIG. 14 is a cross sectional view of a portion of the article of footwear according to another exemplary embodiment of the present disclosure.

Referring now to FIG. 14, another exemplary embodiment of an article of footwear 310 is illustrated. Components that are similar to the embodiments of FIGS. 1-4 are indicated by corresponding reference numerals increased by 300.

As shown, the article of footwear 310 can include an upper 312 and a sole assembly 313. The sole assembly 313 can include an outsole 314. The outsole 314 can be directly coupled to the upper 312. In other embodiments, the sole assembly 313 can include a midsole disposed between the outsole 314 and the upper 312.

In some embodiments, the outsole 314 can be relatively rigid. For instance, the outsole 314 can be made out of relatively hard rubber or other polymeric material, which resists compression under normal loading and yet allows for some degree of flexure along the longitudinal axis of the footwear 310. Accordingly, the outsole 314 can be very durable and robust without significantly reducing comfort or mobility for the wearer.

The outsole 314 can include one or more cleats 317 extending from a lower, outer surface 321 thereof. The cleats 317 can be of any suitable type and can increase traction of the footwear 310. Also, the cleats 317 can be removably attached or integrally attached to the outsole 314. Thus, the footwear 310 can be used for various activities, such as playing football, soccer, baseball, etc.

Also, the outsole 314 can be separated into first and second portions 319*a*, 319*b* by a groove 318. As shown, the groove 318 can extend non-linearly in the thickness direction of the outsole 314. Furthermore, the groove 318 can extend through the entire thickness of the outsole 314. In other embodiments, the groove 318 can extend only partially through the thickness of the outsole 314.

More specifically, the first portion 319*a* can include a projection 337, and the second portion 319*b* can include a recess 339 that receives the projection 337. The projection 337 can have a two- or three-dimensional curvature (e.g., hemispherical curvature), and the recess 339 can have a corresponding curvature, thereby allowing the projection 337 to rotate within the recess 339. For instance, the projection 337 can rotate about an axis of rotation R as indicated by the double-headed arrow in FIG. 14.

Furthermore, the first portion 319*a* can include an abutment surface 341, and the second portion 319*b* can include an abutment surface 343. The abutment surfaces 341, 343 can be disposed adjacent each other, underneath the projection 337 and recess 339, respectively. The abutment surfaces 341, 343 can abut against each other to limit rotation of the first portion 319*a* relative to the second portion 319*b*. Specifically, such abutment can limit rotation of the first portion 319*a* in a clockwise direction in FIG. 14 and can limit rotation of the second portion 319*b* in a counter-clockwise direction in FIG. 14.

Additionally, the groove 318 can be significantly wider on a side of the projection 337 that is opposite the abutment surfaces 341, 343. As such, a gap 345 can be defined, which allows for increased rotation of the first portion 319*a* relative to the second portion 319*b* as will be discussed. Specifically, the gap 345 can allow for increased rotation of the first portion 319*a* in the counter-clockwise direction in FIG. 14 and can allow for increased rotation of the second portion 319*b* in the clockwise direction in FIG. 14.

Furthermore, the footwear 310 can include a biasing structure 320. The biasing structure 320 can be a rigid, non-extendable cord similar to the embodiments discussed above. In other embodiments, the biasing structure 320 can be at least partially resilient and extendable.

The biasing structure 320 can be operably coupled directly to the lower, outer surface 321 of the outsole 314. The biasing structure 320 can extend across the groove 318 and can be operably coupled to both the first and second portions 319*a*, 319*b* of the outsole 314. For instance, the biasing structure 320 can be coupled to the outsole 314 via one or more removably attached fasteners 369. The fasteners 369 can each be U-shaped and can be removably attached to the lower, outer surface 321 at both ends such that the biasing structure 320 is retained between the fastener 369 and the lower, outer surface 321. In other embodiments, the fasteners 369 can be integrally connected to the outsole 314 so as to be monolithic. In some embodiments, the fasteners 369 can slideably receive the biasing structure 320, and in other embodiments, the fasteners 369 can be fixed to the biasing structure 320.

It will be appreciated that the biasing structure 320 can be operably coupled to the outsole 314 in any suitable fashion other than the fasteners 369 without departing from the scope of the present disclosure. Moreover, it will be appreciated that the biasing structure 320 can be operably coupled to the outsole 314 in any suitable location. For instance, the biasing structure 320 can be disposed on a side of the outsole 314 opposite to the lower, outer surface 321 (i.e., adjacent the upper, outer surface of the outsole 314). In other embodiments, the biasing structure 320 can extend through a passageway within the outsole 314 to be contained by the outsole 314 similar to the embodiments of FIGS. 1-4 and discussed above.

Depending on the tension within the biasing structure 320, the first and second portions 319*a*, 319*b* can move relative to each other (e.g., rotate about the axis of rotation R). In some embodiments, tension in the biasing structure 320 can be adjusted as discussed above with respect to the embodiments of FIGS. 1-4. Thus, if the tension in the biasing structure 320 is reduced, the first and second portions 319*a*, 319*b* can rotate or otherwise move relative to each other more easily. Furthermore, if the tension in the biasing structure 320 is increased, the biasing structure 320 can bias the first and second portions 319*a*, 319*b* toward each other, and movement of the first and second portions 319*a*, 319*b* relative to each other is restricted. This is because the increased tension in the biasing structure 320 increases friction between the projection 337 and the recess 339. In some embodiments, the tension in the biasing structure 320 can be high enough such that the first and second portions 319*a*, 319*b* (and any other portions of the outsole 314) are substantially locked together such that the outsole 314 reacts relatively uniformly to outside forces, similar to a one-piece, unitary outsole 314. If desired, the tension in the biasing structure 320 can be reduced to unlock the portions 319*a*, 319*b* of the outsole 314 (e.g., to allow rotation or other movement of the forefoot portion relative to the heel portion).

Also, as shown in FIG. 14, because the biasing member 320 is separated from the axis of rotation R at the distance D, the abutment surfaces 341, 343 can be readily biased toward each other. As such, movement of the first and second portions 319*a*, 319*b* relative to each other can be controlled. In addition, the distance is a lever arm that can provide mechanical advantage to the biasing structure 320 such that less tension is needed in the biasing structure 320 to produce friction between the first and second portions 319*a*, 319*b*.

In addition, it will be appreciated that because the biasing structure 320 is coupled to the outer surface 321 of the outsole 314, the footwear 310 can be manufactured efficiently. For instance, the outsole 314 can be manufactured in a highly-reproducible and inexpensive manner (e.g., molding). Once the outsole 314 has been formed, the biasing structure 320 can be coupled to the outsole 314 using the fasteners 369.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an upper;

a sole assembly that is operably coupled to the upper, the sole assembly defining a ground engaging surface, the sole assembly including a groove that separates the sole assembly into a first portion and a second portion, the groove being open at the ground engaging surface and extending in a depth direction from the ground engaging surface;

a flexible cord including a first end, a second end, and a middle portion, the second end being fixed to an outer surface of one of the upper and the sole assembly, the middle portion extending through the sole assembly and across the groove between the first portion and the second portion; and an adjustment device supported by at least one of the upper and the sole assembly, the adjustment device operably coupled to the first end of the flexible cord, the adjustment device configured to move the first end to selectively adjust tension of the flexible cord between a first tension level and a second tension level, the first portion being more rotatable about the groove relative to the second portion at the first tension level as compared to the second tension level.

2. The article of footwear of claim 1, wherein the groove extends in the depth direction through an outsole and at least a portion of a midsole of the sole assembly.

3. The article of footwear of claim 1, wherein the adjustment device is coupled to the upper and is spaced from the sole assembly.

4. The article of footwear of claim 1, wherein the adjustment device includes a spool, the first end configured to spool on the spool.

5. The article of footwear of claim 1, further comprising a substantially rigid member that is fixed to the sole assembly, wherein the flexible cord wraps at least partially around the substantially rigid member.

6. The article of footwear of claim 1, wherein the second end is fixed to an outer surface of the sole assembly.

7. The article of footwear of claim 1, wherein the article of footwear has a longitudinal axis, wherein the groove extends in a length direction transverse to the longitudinal axis.

8. The article of footwear of claim 7, wherein the article of footwear includes a medial side and a lateral side, and wherein the groove is exposed on the medial side and the lateral side.

9. The article of footwear of claim 1, wherein the cord is resiliently extendable.

10. The article of footwear of claim 1, wherein the cord is nonextendable.

11. The article of footwear of claim 1, wherein the article of footwear includes a posterior portion and an anterior portion, wherein the first end is disposed at the posterior portion of the article of footwear, wherein the second end is fixed to the sole assembly, and wherein the middle portion of the cord extends between the posterior portion and the anterior portion.

12. An article of footwear comprising:

an upper;

a sole assembly that is operably coupled to the upper, the sole assembly defining a ground engaging surface, the sole assembly including a groove that separates the sole assembly into a first portion and a second portion, the groove being open at the ground engaging surface and extending in a depth direction from the ground engaging surface, the sole assembly being flexible for rotation of the first portion relative to the second portion about the groove; and a biasing structure that is elongate and flexible, the biasing structure operably coupled to the sole assembly, the biasing structure including a first end, a second end, and a middle portion that extends between the first end and the second end, the first end being proximate a posterior portion of the sole assembly, the middle portion of the biasing structure extending across the groove between the first portion and the second portion, the second end fixed to an outer surface of one of a medial side and a lateral side of the sole assembly, the biasing structure configured to rotatingly bias the first portion and the second portion generally toward each other about the groove.

13. The article of footwear of claim 12, further comprising an adjustment device that is supported by one of the upper and the sole assembly, the adjustment device coupled to the first end of the biasing structure, the adjustment device configured to move the first end to adjust a tension of the biasing structure between a first tension level and a second tension level, the first portion being more rotatable about the groove relative to the second portion at the first tension level as compared to the second tension level.

14. The article of footwear of claim 12, wherein the middle portion of the biasing structure includes a first part and a second part, wherein the first part extends between the posterior portion and an anterior portion of the sole assembly generally along a longitudinal axis of the sole assembly, wherein the second part is disposed proximate the anterior portion, and wherein the second part extends away from the longitudinal axis toward the one of the medial side and the lateral side.

15. The article of footwear of claim 12, wherein the second end is fixed to the lateral side of the sole assembly.

16. The article of footwear of claim 12, further comprising a substantially rigid member that is fixed to the sole assembly, wherein the middle portion of the biasing structure wraps at least partially around the substantially rigid member.

17. The article of footwear of claim 12, wherein the first end extends out of the sole assembly from the posterior portion of the article of footwear.

18. The article of footwear of claim 15, wherein the flexible cord loops over itself.

19. The article of footwear of claim 12, further comprising a reinforcing tube that is fixedly coupled to the sole assembly, the biasing structure configured to move within the reinforcing tube.

20. The article of footwear of claim 19, wherein the reinforcing tube includes a plurality of anchoring projections that are fixed to the sole assembly.

21. The article of footwear of claim 19, wherein the reinforcing tube is a first reinforcing tube with a projected end, and further comprising a second reinforcing tube with a recessed end, the recessed end configured to rotate within the projected end.

22. An article of footwear having a posterior portion, a medial side, and a lateral side comprising:

an upper;

a sole assembly that is operably coupled to the upper, the sole assembly defining a ground engaging surface, the sole assembly including a groove that separates the sole assembly into a first portion and a second portion, the groove being open at the ground engaging surface and extending in a depth direction from the ground engaging surface, the groove extending in a length direction between the medial side and the lateral side, the groove being exposed on the medial side and the lateral side, the sole assembly being flexible for rotation of the first portion relative to the second portion about the groove; and a flexible cord that is operably coupled to the sole assembly, the flexible cord including a first end, a second end, and a middle portion that extends between the first end and the second end, the first end being proximate the posterior portion, the middle portion extending across the groove between the first portion and the second portion, the second end fixed to an outer surface of one of the medial side and the lateral side, the flexible cord configured to rotatingly bias the first portion and the second portion generally toward each other about the groove.

23. The article of footwear of claim 22, further comprising an adjustment device that is supported by one of the upper and the sole assembly, the adjustment device coupled to the first end of the flexible cord, the adjustment device configured to move the first end to adjust a tension of the flexible cord between a first tension level and a second tension level, the first portion being more rotatable about the groove relative to the second portion at the first tension level as compared to the second tension level.

24. The article of footwear of claim 22, wherein the second end is fixed to the sole assembly.

25. The article of footwear of claim 24, wherein the first end extends out of the sole assembly from the posterior portion of the article of footwear, and wherein the second end is fixed to the lateral side.

* * * * *